US006136265A

United States Patent [19]

Gay

[11] Patent Number: 6,136,265

[45] Date of Patent: Oct. 24, 2000

[54] POWDER METALLURGY METHOD AND ARTICLES FORMED THEREBY

[75] Inventor: David Earl Gay, Pendleton, Ind.

[73] Assignee: Delphi Technologies Inc., Troy, Mich.

[21] Appl. No.: 09/370,320

[22] Filed: Aug. 9, 1999

[51] Int. Cl.[7] ..... B22F 1/00

[52] U.S. Cl. ..... 419/35; 419/36; 419/64; 419/65

[58] Field of Search ..... 419/35, 36, 64, 419/65

[56] References Cited

U.S. PATENT DOCUMENTS

| | | | |
|---|---|---|---|
| 5,069,714 | 12/1991 | Gosselin | 75/252 |
| 5,432,223 | 7/1995 | Champagne et al. | 524/431 |
| 5,472,661 | 12/1995 | Gay | 419/36 |
| 5,567,746 | 10/1996 | Gay | 523/220 |
| 5,595,609 | 1/1997 | Gay | 148/104 |

*Primary Examiner*—Ngoclan Mai
*Attorney, Agent, or Firm*—Margaret A. Dobrowitsky

[57] ABSTRACT

A method of forming a coating on metal particles that can be used to produce powder metallurgy articles, including those for electromagnetic and structural applications. The method is generally a solution-blending process that employs a coating solution that contains a solvent and one or more particulate additives, at least one of which is a polymeric binder that is only partially soluble in the solvent. As a result, only a portion of each binder particle is dissolved in the solvent. Notably, the coating solution is free of a discrete adhesion-promoting (tackifier) additive for adhering the polymeric binder to the metal particles. Instead, each binder particle is sufficiently dissolved in the solvent to promote adhesion of the binder particles to the metal particles during mixing, so that each metal particle is encapsulated with a coating containing the polymeric binder. The particles may then be compacted to bind them together with the coating and form a solid article.

20 Claims, No Drawings

POWDER METALLURGY METHOD AND ARTICLES FORMED THEREBY

TECHNICAL FIELD

The present invention generally relates to powder metallurgy materials and processes. More particularly, this invention relates to a solution blending process for coating metal particles with solid polymer binders, lubricants and potentially other additives prior to compaction, by which such solid additives are coated on the metal particles without the use of an adhesion agent (e.g., tackifier) to adhere the additives to the particle surfaces.

BACKGROUND OF THE INVENTION

The use of powder metallurgy (P/M) is known for forming a variety of net-shape parts that otherwise typically require fabrication by such conventional methods as stamping, machining or die casting. Examples of P/M processes include the molding of metal powders to form structural parts such as gears, frames and wheels, and the molding of iron and iron alloy powders to form magnets, including soft magnetic cores for transformers, inductors, AC and DC motors, generators, and relays. A significant advantage to using powdered metals is that intricate part configurations can be produced without the need to perform additional machining and piercing operations. As a result, the formed part is often substantially ready for use immediately after the forming operation. Various compaction methods are known, including compression molding, injection molding and extrusion, and post-molding operations such as annealing and sintering can often be used to improve mechanical and physical properties, depending on the composition of the powder and the requirements of the application.

P/M compositions can also be tailored to facilitate mixing and compaction of the powder materials and promote the properties of the end P/M product. For example, metallurgical additives and inorganic materials may be added to promote the physical and mechanical properties desired for the product, and lubricants may be mixed with the powder to increase the density achievable during compaction. In situations where a permanent binder is desired, such as AC electromagnetic cores, processes and materials have been developed by which a thin encapsulating layer of a polymer is coated on the powder particles, which are then compression molded to bind the particles together with the polymer. Binders also serve to increase green strength and reduce the incidence of cracking when the compacted article is removed from the die. For this reason, binders have also been employed as temporary additives to powder mixtures. As an example, in structural and DC electromagnetic applications, a binder may be employed to promote green strength in the as-molded article, and later removed by heating. The article can then undergo annealing and sintering as may be necessary to obtain the final properties desired for the article.

Solid additives such as binders and lubricants are often mechanically blended with a dry metal powder, after which the resulting mixture is uniaxially molded into a net-shape part. After molding, the part is heated in a suitable atmosphere to a temperature and for a duration sufficient to remove the lubricant (delube) and then, if appropriate, remove the binder and sinter (fuse) the metal powder together. Binders and lubricants can also be solution blended with metal powders, by which these additives are added in a slurry mixer with a tackifier dissolved in a solvent. Solution blending with a tackifier is employed to reduce dusting and segregation during mixing, and to adhere the solid additives to the metal powder particles. In typical solution-blending methods, the binder and lubricant are insoluble in the solvent, and remain as solid particles in the metal powder slurry created as a result of the dissolved tackifier. As the slurry is mixed, the solvent is evaporated and the binder and lubricant particles are adhered to the metal particles with the tackifier. Similar to articles formed by powders mechanically-blended with binders and lubricants, solution-blended powders are typically heated under appropriate conditions to remove the lubricant and, if desired, the binder, and may be further heated to sinter the metal powder. Articles formed by solution-blending techniques typically exhibit improved green density and green strength over those formed from mechanically-blended powders.

In practice, tackifiers used in solution-blending processes serve only a temporary role to adhere binders, lubricants and/or any other insoluble additives to the metal particles. Any residues of the tackifier that remain within the metal powder can be detrimental to the properties of the powder and resulting article. For example, tackifier residues can degrade the flowability of the powder when introduced into the die, degrade the compressibility of the powder, lower the density of the compacted article, and increase the force required to eject the article from the die. Accordingly, it would be desirable if the advantages of solution-blended powders could be achieved without the use of a discrete adhesion-promoting additive that is detrimental to the P/M process or product.

SUMMARY OF THE INVENTION

The present invention provides a method of forming a coating on metal particles that can be used to produce powder metallurgy articles, including those for electromagnetic and structural applications. The method is generally a solution-blending process employing a coating solution that contains a solvent and one or more particulate additives, at least one of which is a polymeric binder that is only partially soluble in the solvent. As a result, only the low molecular weight fraction of the polymeric binder is dissolved in the solvent. Notably, the coating solution of this invention is free of a discrete adhesion-promoting (tackifier) additive for adhering the polymeric binder to the metal particles. Instead, each particle of the polymeric binder is sufficiently dissolved in the solvent to promote adhesion of the binder particles to the metal particles during mixing, so that each metal particle is encapsulated with a coating containing the polymeric binder. Most insoluble polymers are slightly soluble in certain solvents. More particularly, the low molecular ends of an insoluble polymer tend to be soluble in the appropriate solvent. By using these low Mw ends as the "tackifier" in accordance with this invention, no extra and unwanted additives are required in the coating solution.

After the metal particles are coated by solution-blending with the coating solution, the particles can be compacted to bind them together with the coating and yield a solid article. The binder may be combined with a lubricant prior to encapsulation in order to further promote lubricity and resulting article densities.

According to the invention, appropriately selecting the polymeric binder and solvent so that the binder is partially soluble in the solvent will allow the particulate additives to adhere to the metal particles without the assistance of a discrete adhesion-promoting additive, such as tackifiers conventionally employed in solution-blending processes. The elimination of a discrete adhesion-promoting additive avoids the detrimental effect that such additives can have on the processing of the metal particles and the resulting P/M article, yet achieves the higher green densities and strengths characteristic of solution-blended powders. In view of these benefits, the method of this invention is well suited for forming structural articles and both DC and AC electromagnetic articles.

Other objects and advantages of this invention will be better appreciated from the following detailed description.

DESCRIPTION OF THE PREFERRED EMBODIMENT

According to the present invention, a P/M method is provided by which metal particles are coated by solution-blending with a polymeric binder without a discrete adhesion-promoting additive. The method yields an encapsulating layer of the binder to promote the green strength and density of the article produced when the metal particles are appropriately compacted. The encapsulating layer may also include other additives, such as lubricants, metal and nonmetal additives, that promote the flow and compaction of the particles during molding and/or promote various properties desired for the resulting P/M article.

Preferred materials for the particles will depend on the particular P/M product of interest. Ferromagnetic materials for the manufacturing of electromagnetic articles, such as magnetic cores, include iron, nickel and cobalt alloys, iron-silicon alloys, iron-phosphorus alloys, Fe—Si—Al alloys such as Sendust alloys (nominally Fe-5.6Al-9.7Si), ferrites and magnetic stainless steels. Structural materials include ferrous alloys such as iron and stainless, high-performance and low-alloy steels, and nonferrous materials such as noble metals and aluminum, copper, magnesium, titanium, tungsten, zinc and their alloys. Also encompassed by this invention are any of the above materials coated with a metal or ceramic material, such as a silicate (sodium silicate, potassium silicate, silica, etc.), metal oxide (alumina, zirconia, steatite, calcia, beryllia, etc.), boride, nitride (silicon nitride, boron nitride, titanium nitride, etc.), carbide (silicon carbide, boron carbide, zirconium carbide, titanium carbide), ferrite ($NaFeO_2$, $MgFe_2O_4$, $K_3FeO_6$, $SrFe_{12}O_{19}$), or phosphate (FeP, $Fe_2P$, $Fe_3P$). A suitable average particle size range is about 5 micrometers to about 1000 micrometers, with a preferred average size being about 100 micrometers to 200 micrometers.

The coating solution used to form the encapsulating layer generally contains a solvent, a binder that is only partially soluble in the solvent, and potentially other additives that are preferably insoluble in the solvent. The encapsulating layer is generally formed of the insoluble constituents of the coating solution, and is preferably present on each metal particle in an amount of about 0.10 to about 10 weight percent, and preferably about 0.20 to about 0.50 weight percent. Binder materials suitable for the encapsulating material of this invention include polyesters, polyolefins, polyamides and polyimides, which have low and higher molecular weight components, with preferred binders being phenolic resins, including but not limited to epoxies, alkyds, polyesters and silicones. The binder material is in particulate form within the coating solution, the individual particles of which are adhered to the metal particles to form the encapsulating layer. Other insoluble additives to the encapsulating layer are present as necessary to promote the various physical, metallurgical, mechanical and/or electromagnetic properties desired for the metal particles and P/M article. Such additives generally include known lubricants and metal and nonmetal (e.g., ceramic) additives. Lubricants are used to promote the flow characteristics of the other insoluble additives and the metal particles during molding. Suitable known lubricants include stearates, fluorocarbons, waxes, low-melting polymers and synthetic waxes such as ACRAWAX available from Lonza, Inc.

A suitable composition for a coating solution of this invention is about one to about ten weight percent of the particulate polymer binder, up to about five weight percent of a particulate lubricant, up to about five weight percent of a particulate inorganic additive, with the balance being the organic solvent. Notably absent from this list of additives are tackifiers and other adhesion promoters conventionally used in solution-blending processes to adhere the insoluble constituents of the coating solution to the metal particles. More particularly, the coating solution employed by this invention lacks the usual presence of a tackifier that is completely soluble in the solvent. Instead, the present invention relies on the selection of a binder and solvent that, under appropriate solution-blending conditions, renders a portion of the binder sufficiently soluble to cause the surface of each metal particle to adhere the insoluble binder particles and any other insoluble additives to the metal particles. More particularly, the solvent is used to dissolve a low molecular weight component of the selected binder, while higher molecular weight components of the binder remain undissolved. For the preferred phenolic resins, preferred solvents are volatile organic solvents, such as higher alcohols, chlorinated and aliphatic solvents. Under mixing conditions that are generally conventional for the binder and metal particles, the preferred organic solvents will dissolve a sufficient portion of a phenolic binder to adhere the binder particles and other insoluble additives of the coating solution to the metal particles.

Various solution blending techniques can be employed to coat metal powders in accordance with this invention. Two commercially known examples are the ANCORBOND process available from Hoeganaes of Riverton, N.J., and the FLOWMET process available from Quebec Metal Powders Ltd., of Tracy, Quebec, Canada. Molding of metal particles encapsulated by the method of this invention can be performed using various compaction techniques known and used in the art to form net-shaped powder metal articles. Examples include uniaxial compaction, isostatic compaction, dynamic magnetic compaction, extrusion and metal injection molding. Binders of this invention benefit from warm pressing during compaction to promote moldability and maximize green density and strength. Suitable pressing temperatures are generally in a range from about 150° F. (about 65° C.) to about 350° F. (about 175° C.), with a preferred range being about 225° F. to about 275° F. (about 105° C. to about 135° C.) for phenolic resin binders.

For certain applications, including AC electromagnetic cores, the green article produced by compaction will have a suitable net shape for use as-is. For DC electromagnetic applications and many structural applications, the green article is required to undergo a heat treatment to remove the binder and any lubricant, and then anneal and sinter the particles. A suitable temperature range for removing a phenolic binder is about 700° F. to about 1100° F. (about 370° C. to about 595° C.). After removing the polymer constituents of the encapsulating layer, annealing is useful because compaction work-hardens the particles to some degree, reducing desirable mechanical properties and, if applicable, magnetic properties, including reduced permeability and increased hysteresis loses. Annealing is performed by heating to an appropriate temperature for the particle material, followed by slow cooling. If the particles are formed of a ferromagnetic material such as an iron, iron-silicon, iron-phosphorus, or Fe—Si—Al alloy, annealing can typically be performed within a temperature range of about 900° F. to about 1400° F. (about 480° C. to about 760° C.). A preferred annealing treatment is carried out at about 1100° F. to about 1200° F. (about 590° C. to about 650° C.) for about 30 to about 90 minutes, depending on the mass of the article.

After annealing, the article may be used as-is though for most applications, the article undergoes sintering to fuse the metal particles together. Suitable sintering temperatures will depend on the composition of the particles. Ferrous particles can be sintered at about 2050° F to about 2400° F. (about 1120° C. to about 1315° C.), preferably about 2050° F. (about 1120° C.). Copper particles can be sintered at about 1400° F to about 1700° F. (about 760° C. to about 925° C.), preferably about 1500° F. to about 1600° F. (about 815° C. to about 870° C.). Aluminum particles can be sintered at about 1100° F. to about 1200° F. (about 595° C. to about 650° C.).

During an investigation leading to this invention, an iron powder available under the name 1001HP from Quebec Metal Powders was mechanically blended with about 0.30 weight percent of a phenolic resin powder. During blending, yellow dusting occurred in the air and on the blending equipment and container to the extent that an exhaust hood would be required to reduce the hazard of exposure. Compaction by dynamic magnetic compaction (DMC) at a field of about 50 to 200 Oe produced a green article that ejected readily from the copper die in which compaction took place.

In a second run, a sample of the 1001HP powder was solution blended using the FLOWMET process with about 0.30 weight percent of the same phenolic resin powder. The remainder of the coating solution was not made available by the coating vender, but included a tackifier and a solvent believed to be acetone in amounts of about 0.05 to 0.10 weight percent. The process yielded a coated powder with a more uniform coated particle distribution than the mechanically blended specimen, and did not dust when handled. However, compaction under the same conditions noted above produced a green article that would not eject from the copper die.

Finally, a sample of the 1001HP powder was solution blended using the FLOWMET process with about 0.30 weight percent of the same phenolic resin powder and with the same solvent and amount used in the previous example, but without any tackifier. The process yielded a coated powder with a uniform particle distribution similar to that for the conventional FLOWMET process. Furthermore, compaction under the same conditions previously used produced a green article that ejected easily from the copper die.

While the invention has been described in terms of a preferred embodiment, it is apparent that other forms could be adopted by one skilled in the art. Accordingly, the scope of the invention is to be limited only by the following claims.

What is claimed is:

1. A method of forming a coating on metal particles, the method comprising the steps of:

forming a coating solution of a solvent and at least one particulate additive, the at least one particulate additive comprising a polymeric binder that is only partially soluble in the solvent such that only a portion of each particle of the polymeric binder is dissolved, the coating solution being free of a discrete tackifier additive for adhering the polymeric binder to the metal particles; and then blending the metal particles with the coating solution, each particle of the polymeric binder being sufficiently dissolved to adhere the polymeric binder to the metal particles so as to encapsulate the metal particles with a coating containing the polymeric binder.

2. A method according to claim 1, wherein the polymeric binder is chosen from the group consisting of polyesters, polyolefins, polyamides and polyimides having relatively lower and higher molecular weight components.

3. A method according to claim 2, wherein the solvent is a volatile organic solvent.

4. A method according to claim 1, wherein the solution consists essentially of the solvent and the polymeric binder.

5. A method according to claim 1, wherein the at least one particulate additive consists essentially of the polymeric binder and at least a second particulate additive that is insoluble in the solvent.

6. A method according to claim 5, wherein the second particulate additive is chosen from the group consisting of lubricants and inorganic additives.

7. A method according to claim 1, wherein the metal particles are formed of a ferromagnetic material.

8. A method according to claim 1, further comprising the step of compacting the metal particles to bind the metal particles with the polymeric binder and form a solid article.

9. A method according to claim 8, wherein the solid article is an AC electromagnetic article.

10. A method according to claim 8, wherein the metal particles are coated with a ceramic material prior to the blending step.

11. A method according to claim 8, further comprising the step of heating the solid article to remove the coating and fuse the metal particles to form a sintered article.

12. A method according to claim 11, wherein the sintered article is a DC electromagnetic article.

13. A method according to claim 1, wherein the polymeric binder constitutes about one to about ten weight percent of the coating solution, the coating solution further comprising up to about five weight percent of a particulate lubricant, up to about five weight percent of a particulate inorganic additive, with the balance being the solvent.

14. A method of solution blending ferromagnetic particles and a coating solution to form a coating on the ferromagnetic particles, the method comprising the steps of:

forming the coating solution to consist essentially of an organic solvent and at least one particulate additive, the at least one particulate additive comprising a polymeric binder having a relatively higher molecular weight portion that is not soluble in the solvent and a relatively lower molecular weight portion that is soluble in the solvent, the coating solution being free of a discrete tackifier additive for adhering the polymeric binder to the ferromagnetic particles; and then solution blending the coating solution and the ferromagnetic particles until the solvent has evaporated, each particle of the polymeric binder being sufficiently dissolved to adhere the at least one particulate additive to the ferromagnetic particles so as to encapsulate the ferromagnetic particles with a coating containing the polymeric binder.

15. A method according to claim 14, wherein the polymeric binder is a phenolic resin chosen from the group consisting of epoxies, alkyds, polyesters and silicones.

16. A method according to claim 14, wherein the at least one particulate additive consists of the polymeric binder and at least a second particulate additive that is insoluble in the solvent.

17. A method according to claim 14, further comprising the step of compacting the ferromagnetic particles to bind the ferromagnetic particles with the polymeric binder and form a solid article.

18. A method according to claim 14, wherein the ferromagnetic particles are coated with a ceramic material prior to the solution blending step.

19. A method according to claim 17, further comprising the step of heating the solid article to remove the coating and fuse the ferromagnetic particles to form a sintered article.

20. A method according to claim 14, wherein the coating solution consists essentially of about one to about ten weight percent of the polymeric binder, up to about five weight percent of a particulate lubricant, up to about five weight percent of a particulate inorganic additive, with the balance being the organic solvent.

* * * * *